US005604952A

United States Patent [19]

Zeleznick

[11] Patent Number: 5,604,952

[45] Date of Patent: Feb. 25, 1997

[54] INTERPROXIMAL TOOTHBRUSH

[76] Inventor: Glenn Zeleznick, 8158 Beverly Blvd., Los Angeles, Calif. 90048

[21] Appl. No.: 587,019

[22] Filed: Jan. 16, 1996

[51] Int. Cl.[6] ..... A46B 3/18

[52] U.S. Cl. ..... 15/167.1; 15/206; 15/227

[58] Field of Search ..... 15/167.1, 206, 15/207, 227; 132/308

[56] References Cited

U.S. PATENT DOCUMENTS 3,505,700 4/1970 Rodriguez ..... 15/227
3,720,975 3/1973 Nelson ..... 15/206
4,628,949 12/1986 Mas et al. ..... 15/227
4,691,404 9/1987 Tarrson et al. ..... 15/206

*Primary Examiner*—David Scherbel
*Assistant Examiner*—Tony G. Soohoo
*Attorney, Agent, or Firm*—Roger A. Marrs

[57] ABSTRACT

A fingertip toothbrush is disclosed herein employing a tapered spiral brush having bristles carried on a wire support in coaxial relationship and outwardly projecting from the end of a cup-like base member. The base member includes an internal recess with an opening or entrance for insertably receiving the tip of the user's finger. A semicircular slot is provided in the base member through which an extended fingernail may be accommodated. A reinforcement element secures the wire support and the bristles on the base member.

2 Claims, 1 Drawing Sheet

FIG. 1
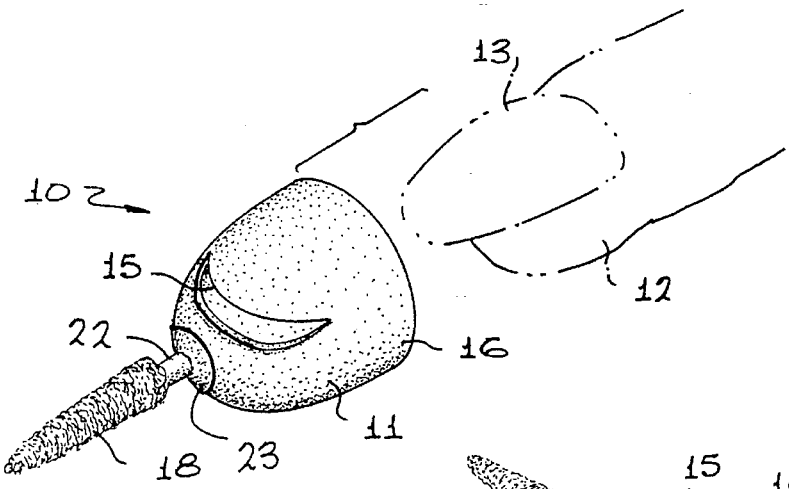
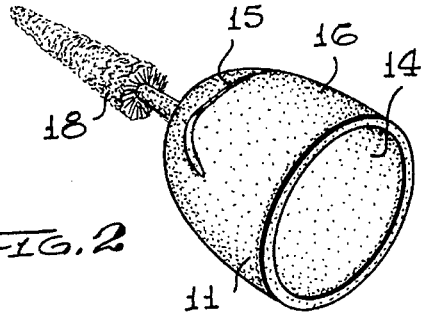
FIG. 2
FIG. 3
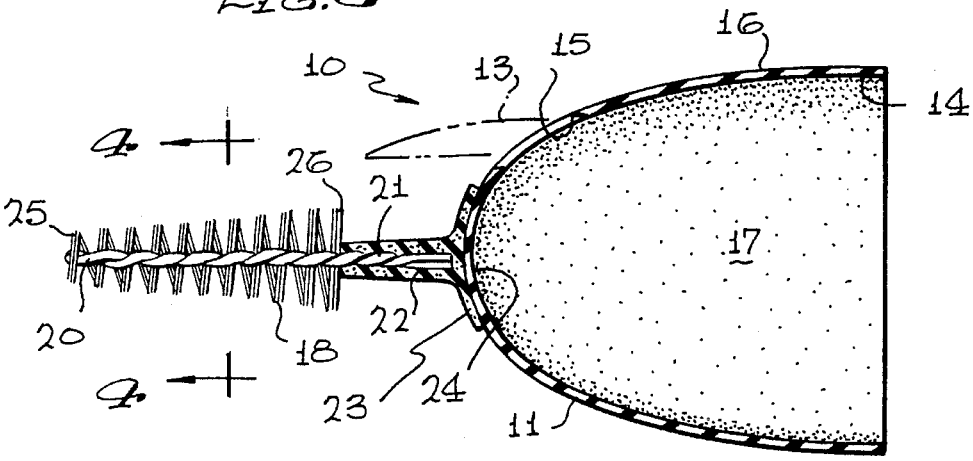
FIG. 4
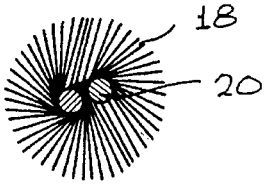
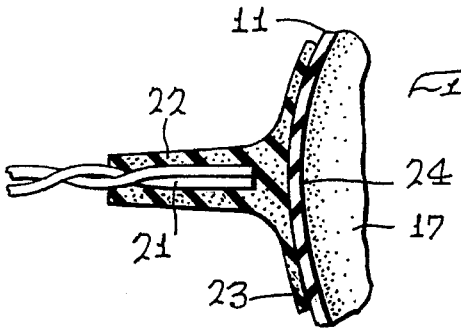
FIG. 5

INTERPROXIMAL TOOTHBRUSH

BACKGROUND OF THE INVENTION

1. Field of the Invention

The present invention relates to the field of dental appliances and more particularly to a novel compact fingertip toothbrush which utilizes a tapered spiral brush having bristles carried on a wire support.

2. Brief Description of the Prior Art

In the past, it has been the conventional practice to employ compact toothbrushes in the form of fingertip devices in the practice of brushing one's teeth. Examples of such fingertip toothbrushes are disclosed in U.S. Pat. No. 5,392,482; 4,292,705; 3,505,700 and 4,292,705. Although such prior fingertip brushes and massaging units have helped in the practice of dental hygiene, problems and difficulties have been encountered which stem largely from the fact that the brushes or prongs on such devices fail to reach debris which is deeply lodged between the teeth and gums. The brushes or prongs on conventional devices are Used for scraping or cleansing the external surfaces of tenth and for massaging gums without consideration for deep probing into spaces between teeth and particularly adjacent to the gums. Such lack of cleansing and debris removal leads to deep pocket infection and gum damage.

Therefore, a long-standing need exists to provide a convenient brush and probe for introduction into spaces between teeth and the gum area so that deeply hidden food particles and other debris can be readily removed in a convenient manner. Such a device may be carried on the fingertip of the user and should outwardly project from the tip of the device so that it may be introduced into areas of the dental structure heretofore unreachable by conventional means.

SUMMARY OF THE INVENTION

Accordingly, the above problems and difficulties are avoided by the present invention which provides a fingertip toothbrush employing a tapered spiral brush having bristles which are secured to a wire support having its end secured to a mounting element. The mounting element is affixed to the end of a finger "cot" or base member which includes an open recess into which the user's fingertip is inserted. The material of the base member is pliable and resiliently flexible so that the member may readily be installed on the fingertip or removed therefrom. Additionally, an elongated slot or aperture is provided in the base member for accommodating passage of a fingernail so that the base member will seat against the fleshy part of the user's fingertip.

Therefore, it is among the primary objects of the present invention to provide a novel fingertip toothbrush which includes a tapered spiral arrangement of bristles which are coaxially disposed with respect to a base member so that the user has convenience and comfort in cleansing the teeth, particularly in spaces between teeth and along the gum line.

Another object of the present invention is to provide a novel toothbrush removably carried on the end of a user's fingertip, which includes a spiral bristle brush carried on the extreme end of a base member so that the brush may be readily projected outwardly in an unrestricted manner for insertion into .spaces between teeth and gums in order to effect a thorough dental cleansing.

Another object of the present invention is to provide a novel toothbrush which is carried-on the fingertip of the user having a tapered spiral arrangement of bristles outwardly projecting from the extreme end of a base member into which the fingertip is inserted so that the brush may be introduced to areas between the user's teeth so as to dislodge food particles or the like therefrom.

BRIEF DESCRIPTION OF THE DRAWINGS

The features of the present invention which are believed to be novel are set forth with particularity in the appended claims. The present invention, both as to its organization and manner of operation, together with further objects and advantages thereof, may be be understood with reference to the following description, taken in connection with the accompanying drawings in which:

FIG. 1 is a front perspective view of the novel fingertip toothbrush incorporating the present invention preparatory for mounting on the fingertip of a user;

FIG. 2 is a rear perspective view of the fingertip toothbrush device shown in FIG. 1;

FIG. 3 is an enlarged longitudinal cross-sectional view of the fingertip toothbrush shown in FIGS. 1 and 2;

FIG. 4 is a transverse cross-sectional view of the arrangement of bristles employed in the fingertip toothbrush of FIG. 3 as taken in the direction of arrows 4—4 thereof; and FIG. 5 is an enlarged fragmentary view, in section, of the bristle or brush support means employed in the fingertip toothbrush of the present invention.

DESCRIPTION OF THE PREFERRED EMBODIMENT

Referring to FIG. 1, the novel fingertip toothbrush of the present invention is illustrated in the general direction of arrow 10 which includes a cup-like shaped base member 11 adapted to be placed over the fingertip of a user. The fingertip is indicated by numeral 12 which includes an elongated fingernail 13. The base member 11 is hollow on the inside and presents an open cavity such as indicated by numeral 14 in FIG. 2 for insertably receiving the fingertip and the nail 13. An elongated slit or opening 15 is provided in the forward portion of the base member for insertably receiving the fingernail 13 when the fingertip 12 is inserted into the cavity of the base member. Preferably, the cup-like base member is composed of a resilient and pliable material so that a sufficient fit ensues between the base member and the fingertip to hold the base member onto the fingertip during use. It is to be understood that the opening or slit 15 is of sufficient space to permit a curved or shaped fingernail 13 to be accommodated. Therefore, the slit may be curved or straight. Directly behind the opening 15 is a portion 16 of the base member which will preferably pass over the fingernail 13 to engage with the upper portion of the fingertip 12. A definite interference fit is established between the base member and the tip of the finger.

Referring now in general to FIGS. 1–3, it can be seen that the fingernail protrudes through the opening or slit 15 so that it outwardly projects forward of the base member 11. In some instances, a roughened interior surface 17 of the base member is provided in order to effect a more secure, but yieldable, interference fit.

Referring now in detail to FIGS. 3–5 inclusive, it can be seen that the fingertip brush of the present invention includes a brush composed of bristles arranged in a tapered spiral arrangement and such an arrangement is illustrated by numeral 18. Preferably, the bristles are carried in a spiral fashion about a single or double wire support illustrated by numeral 20, which has an end 21 carried in a mounting element 22. One end of the mounting element is flat and permits the wire with the bristle brush to extend or project upwardly therefrom. The opposite end of the mount includes an arcuate member 23 which conforms to the rounded tip or end 24 of the base member. Although a double wire support is shown for the bristle arrangement 18, it is to be understood that at least one wire may be used or any multiple thereof in order to arrange the bristles in a radial fashion, as shown in FIG. 4, about the wire and particularly in an outwardly tapered configuration so that the bristles of least diameter are on the tip of the brush as represented by numeral 25, while bristles having the greatest diameter are at the back end of the brush, as represented by numeral 26.

In FIG. 5, it can be seen that the end of the wire support 21 is fixedly embedded within the material of the support element 22 so that the brush 18 will not rotate within the mounting element. Therefore, it is emphasized that back and forth or up and down movements are permitted so that engagement of the bristles may cover substantially exposed areas of the teeth as well as hidden areas between teeth and adjacent to the gums. The tapered arrangement of the bristles permits insertion of the smaller diametered bristles into the spaces between teeth and adjacent gums for thorough cleansing and debris removal. The user has the ability and opportunity to insert the tapered and spiral bristle arrangement as far as practical between teeth and against gum locations.

In view of the foregoing, it can be seen that the novel fingertip toothbrush of the present invention provides an improved and convenient means for removing debris and foreign matter from the user's mouth. The bristles may be placed into spaces and openings between teeth and against the gums for limited massage purposes. The appliance is lightweight and may be readily carried and manipulated on the end of a fingertip as the user moves his hand and finger for insertion of the tapered and spiral brush into the mouth against teeth and gums. Since the bristles are arranged in a spiral fashion, a spiral groove or space is defined between the radially projecting bristles which may be occupied by debris, dental paste or the like. The space between the radial bristles operates as a means for carrying debris out of the mouth or the dental preparation into the mouth. The fingernail may be accommodated as well as the tip of the finger and the aperture or slot 15 is formfitting and matable with the configuration of the nail 13.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An interproximal toothbrush comprising:

a base member having two opposite ends, one end of which has an internal recess for insertably receiving the fingertip of a user and the other end having a curved surface;

an elongated brush support having a plurality of bristles outwardly projecting from said base member;

a mounting element fixedly attaching said brush to said curved surface of said base member;

said elongated brush having a bristle arrangement of said bristles in a tapered spiral plurality of radiating individual bristles, said bristles radiating outwardly from said elongated brush support;

said elongated brush support having at least one twisted wire carrying said bristles in outwardly radiating formation with smaller diameter bristles at one end of said brush and larger diameter bristles at its other end; and said mounting element includes an arcuate portion mateable with and affixed to said curved surface.

2. The invention as defined in claim 1 wherein:

said plurality of bristles provide a tapered spiral array of said bristles, said tapered spiral array forming a continuous circular formation of said bristles having some of said bristles in a disc-like formation normal to said twisted wire and other of said bristles in angular displacement formation with respect to said twisted wire.

* * * * *